US005392752A

United States Patent [19]

Brogan et al.

[11] Patent Number: 5,392,752

[45] Date of Patent: Feb. 28, 1995

[54] FUEL-AIR MIXING DEVICE FOR AN INTERNAL COMBUSTION ENGINE

[75] Inventors: Jack F. Brogan, San Pedro, Calif.; Raymond B. Russell, Clinton, Tenn.

[73] Assignee: Combustion Efficiency, Inc., New York, N.Y.

[21] Appl. No.: 213,560

[22] Filed: Mar. 16, 1994

[51] Int. Cl.[6] ..... F02M 33/02

[52] U.S. Cl. ..... 123/591

[58] Field of Search ..... 123/590, 591, 593; 48/189.4

[56] References Cited

U.S. PATENT DOCUMENTS

| | | | |
|---|---|---|---|
| 3,747,581 | 7/1973 | Kolb | 123/591 |
| 3,847,125 | 11/1974 | Malherbe | 123/591 |
| 4,295,458 | 10/1981 | Pellerin | 123/591 |
| 4,381,756 | 5/1983 | Waschkuttis | 123/591 |
| 4,452,219 | 6/1984 | Tay-Lodge et al. | 123/591 |
| 4,699,114 | 10/1987 | Giannotti | 123/591 |
| 4,974,573 | 12/1990 | Jensen | 123/593 |

*Primary Examiner*—E. Rollins Cross
*Assistant Examiner*—Erick Solis
*Attorney, Agent, or Firm*—Thomas G. Carulli; Peter J. Phillips

[57] ABSTRACT

The disclosure is directed to a fuel-air mixing device for an internal combustion engine. The fuel-air mixing includes an inner elongated hollow body portion for delivering a fuel-air mixture from a carburetor or a fuel-injection device into the inlet of the intake manifold of the engine. The device includes an outer elongated body portion within which the inner body portion is disposed. The cavity is formed between the interior surface of the outer body portion and the exterior surface of the inner body portion. The cavity is open at one end portion facing the flow of the fuel-air mixture. The opposite end of the cavity is closed. The fuel-air mixture contains droplets of fuel which pass adjacent the inner surface of the carburetor or the fuel injection device. Such droplets enter the opening of the cavity of the mixing device and accumulate therein. Additional in the mixing device enable a small portion of the flow of the fuel-air mixture to move inwardly therethrough and into the cavity. As a result, the small portion of flow causes the liquid fuel within cavity to pass through the opening of the cavity, into the inner body of the mixing device, and into the main flow of the fuel-air mixture passing through inner body portion. Thereby, the liquid fuel droplets accumulated in the cavity are vaporized within the flow of fuel-air mixture entering the inlet of the engine.

16 Claims, 4 Drawing Sheets

FUEL-AIR MIXING DEVICE FOR AN INTERNAL COMBUSTION ENGINE

The invention relates to a fuel-air mixing device which is adapted to be mounted adjacent in the inlet of an internal combustion engine to improve the fuel-air mixture by vaporizing droplets of fuel to minimize the delivery of droplets of fuel to the inlet of the engine.

BACKGROUND OF THE INVENTION

1. Field of the Invention

The invention relates to a fuel-air mixing device which is adapted to be mounted adjacent the fuel-air mixture inlet of an internal combustion engine such as adjacent the inlet of the intake manifold of the engine. The top portion of the mixing device has a flange which can be disposed between the upper portion of the inlet of the engine and the lower portion of a carburetor or a fuel injection device for delivering fuel to the inlet. The fuel-air mixture passes from the carburetor or the fuel injection device into the mixing device and then into the inlet of the intake manifold of the engine. The fuel-air mixture contains droplets of unvaporized fuel which pass adjacent the inner surface of the carburetor or beyond the fuel injection device. Such droplets enter the opening of the mixing device and accumulate in a cavity between the inner and outer bodies of the mixing device. A small portion of the flow of the fuel-air mixture to the inlet of the intake manifold enters the cavity of the fuel-air mixing device and causes the droplets of liquid fuel within cavity to enter the fuel-air mixture passing through the mixing device. As a result, the liquid fuel droplets are completely vaporized within the flow of the fuel-air mixture entering the inlet of the intake manifold.

2. Description of the Prior Art

U.S. Pat. No. 3,057,335, expired Oct. 9, 1979, shows a recess to trap unvaporized fuel.

U.S. Pat. No. 3,458,297, expired Jul. 29, 1980, shows a ring inserted into the inlet of the intake manifold of an engine with the ring having a recess to collect unvaporized fuel.

U.S. Pat. No. 3,512,511, expired May 19, 1987, shows a groove to trap unvaporized fuel.

U.S. Pat. No. 3,847,125, expired Nov. 12, 1991, shows a gutter to trap unvaporized fuel.

U.S. Pat. No. B1 3,952,716 expired Apr. 27, 1993, shows a center body in an air-fuel mixture flow path to subdivide fuel droplets.

U.S. Pat. No. 4,381,756, issued May 3, 1983, shows an annular recess to trap unvaporized fuel.

U.S. Pat. No. 4,643,158, issued Feb. 17, 1987, shows a groove to trap unvaporized fuel.

SUMMARY OF THE INVENTION

The fuel-air mixture passes into the fuel-air mixing device of the invention, through the inner body of the mixing device, and into the inlet of the intake manifold. The fuel-air mixture contains droplets of fuel which pass adjacent the inner surface of the carburetor or the fuel injection device. Such droplets enter the opening formed between a flange of the outer body and a flange of the inner body of the mixing device. After the droplets enter the opening of the mixing device, the droplets accumulate in the cavity formed between the inner and outer bodies of the mixing device. Openings in the mixing device enable a small portion of the flow of the fuel-air mixture to move inwardly there through and into the cavity. The result is that the small portion of flow causes the droplets of liquid fuel within cavity to pass over the upper flange of the inner body of the mixing device and to enter the main flow of the fuel-air mixture passing through inner body. As a result, the liquid fuel droplets are vaporized within the flow of fuel-air mixture.

DETAILED DESCRIPTION OF PREFERRED EMBODIMENTS

Figure 1:
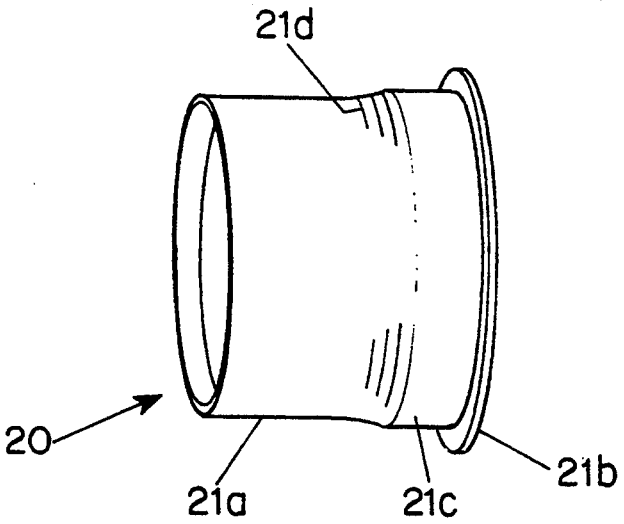
FIG. 1 is a perspective view of an embodiment of the fuel-air mixing device of the invention.
Figure 3:
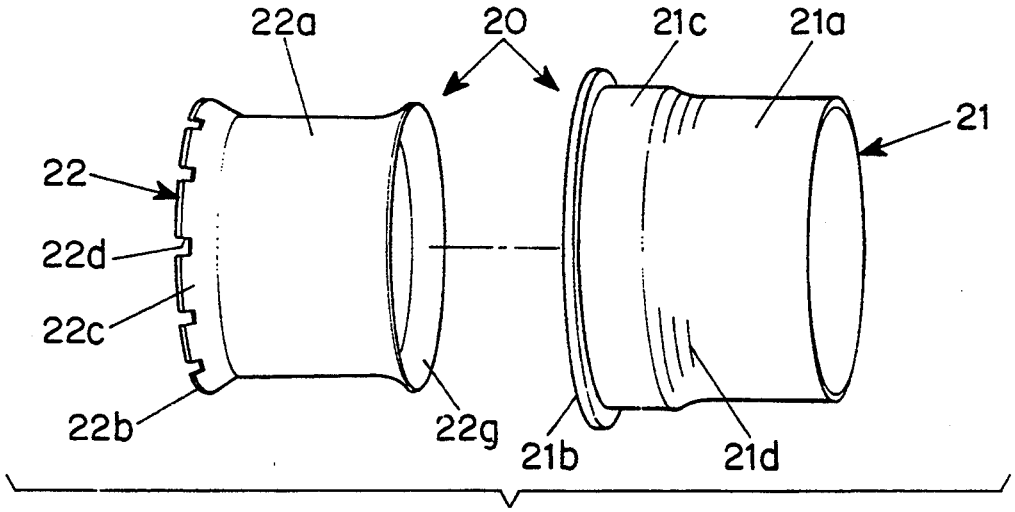
FIG. 3 is a perspective view of the inner body and the outer body of the embodiment of the fuel-air mixing device shown in FIG. 1.

The fuel-air mixing device 20 of the invention is shown in FIG. 1 and FIG. 3. Fuel-air mixing device 20 includes an outer elongated portion body portion 21 and an inner elongated body portion 22. As shown in FIG. 1, the device 20 may be cylindrical in form having cylindrical body with a thin wall section 21 a. At one end portion of outer body 21 there is flange **21*b* extending outwardly therefrom. Adjacent to flange 21*b* there is disposed portion 21*c* of increased diameter as compared to the diameter of outer body 21. The portion of increased diameter 21*c* provides a mounting surface for outer body 21. The surface of flange of 21*b* can cooperate with increased diameter portion 21*c* in mounting outer body 21** with respect to an engine.

Figure 2:
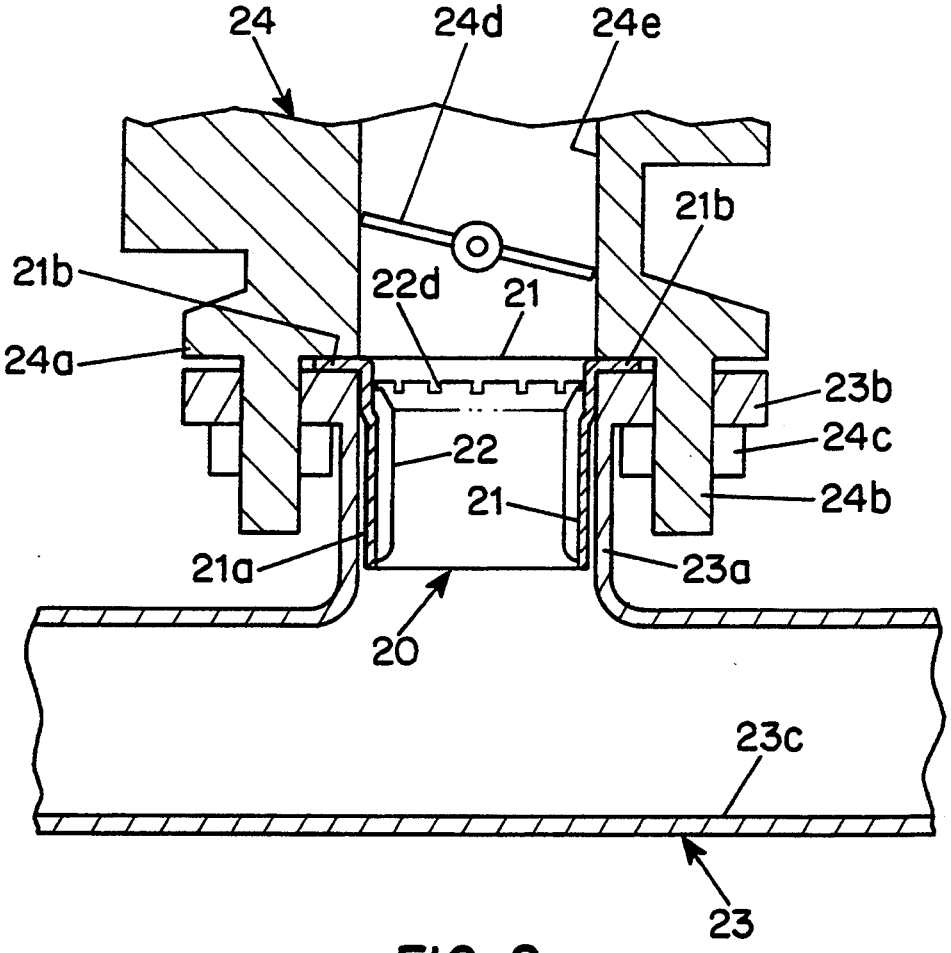
FIG. 2 is a vertical section view of the fuel-air mixing device mounted adjacent in the inlet of an intake manifold.
Figure 4:
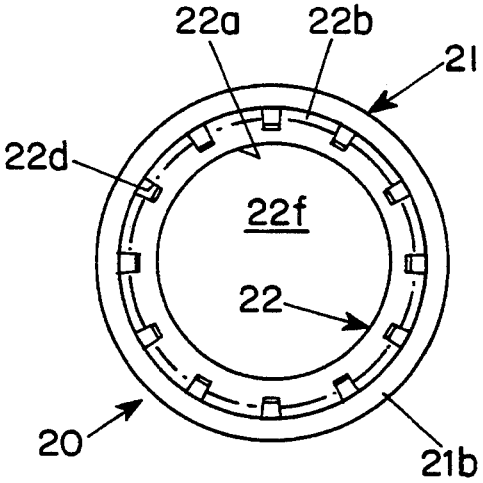
FIG. 4 is top plan view of the fuel-air mixing device of FIG. 1.
Figure 5:
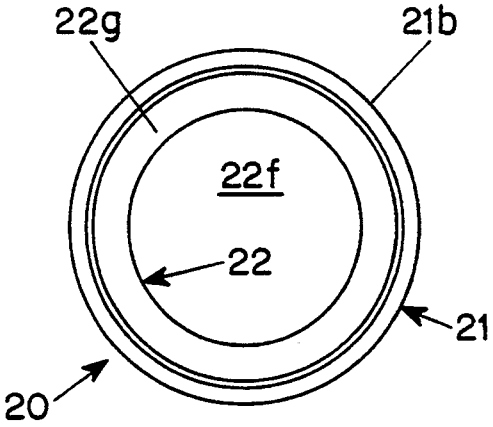
FIG. 5 is a bottom plan view of the fuel-air mixing device of FIG. 1.
Figure 7:
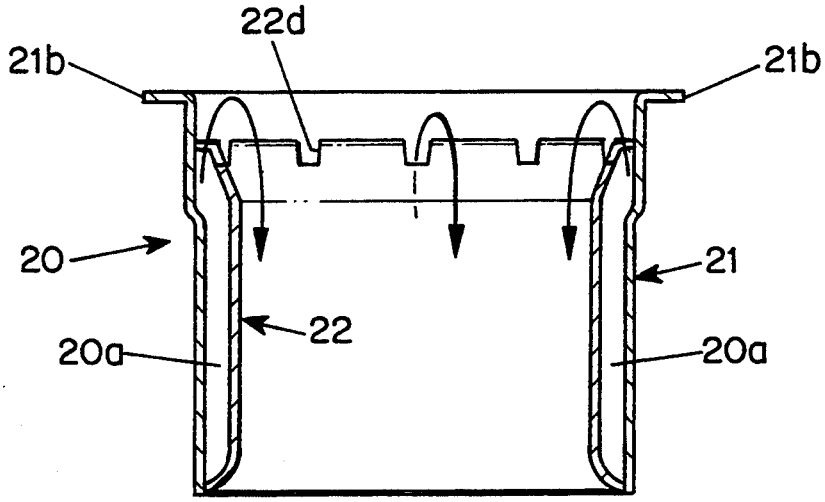
FIG. 7 is a fragmentary vertical section of the walls of the inner and outer bodies of the mixing device with a cavity therebetween.
Figure 6:
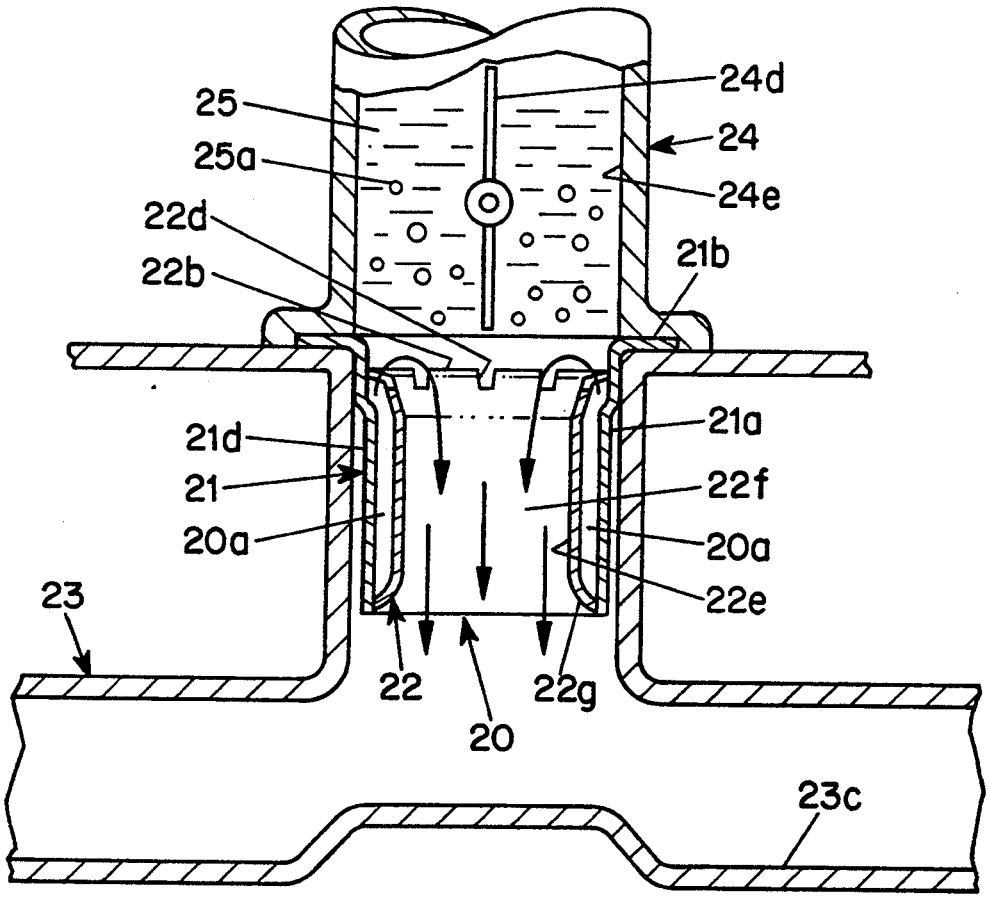
FIG. 6 is a fragmentary vertical section view of the fuel-air mixing device mounted in the inlet of an intake manifold.

As shown in FIG. 3, inner body 22 which is cylindrical in form and having wall portion **22*a* also includes flange 22*b* adjacent end portion 22*c*. Flange 22*b* can be provided with serrations or indentations 22*d*. As shown in FIG. 4, inner body 22 when assembled with outer body 21 to form fuel-air mixing device 20 is inserted into outer body 21 with flange 22b being disposed adjacent to flange 21b of the outer body 21. The periphery of flange 22b and the inner surface of flange 21b of the outer body form an entrance or an inlet opening into the cavity 20 as shown in FIGS. 2 and 6. As shown in FIG. 4, the inner surface of the cylindrical inner body 22 forms a cylindrical opening 22f. In FIG. 5 it can seen that flange 22g extends from wall 22a of the inner body 22. Flange 22g** can be in the form of flare.

Fuel-air mixing device 20 comprises, inner body 22 mounted or nested within outer body 21 as shown in FIGS. 2 and 6. Such nesting creates cavity 20a between the interior surface of outer body 21 and the exterior surface of inner body 22 as shown in FIGS. 2 and 6. Outer body 21 can be provided with one or a plurality of openings 21d as shown in FIGS. 1 and 3. The plurality of openings 21d can be positioned symmetrically about the periphery of outer body 21 and may be in the form of slots.

It should be noted that although the fuel-air mixing device 20 comprises an inner body 22 and outer body 21 forming cavity 20a therebetween, the device 20 can be formed by the assembly of separate inner body 22 and outer body 21 or, in the alternative, the device 20 can be cast or otherwise formed as an integral unit or assembly.

In FIG. 2 there is shown a portion of an internal combustion engine which includes intake manifold or inlet 23 having an inlet or opening 23a. The opening or inlet 23a can include a mounting pad 23b upon which a carburetor 24 or fuel-air injection device can be mounted. As shown in FIG. 2 carburetor 24 has a mounting surface 24a engaged mounting pad 23b. The carburetor is retained on the mounting pad by studs 24b and nuts 24c. The carburetor includes a throttle plate 24d which is rotated from a closed position shown in FIG. 2, that is the idle position, to a full-throttle position (not shown) in which throttle plate 24d extends vertically in FIG. 2.

As shown in FIG. 2 carburetor 24 is adapted to deliver a fuel-air mixture downwardly as viewed in FIG. 2 and past throttle plate 24d in the direction of inlet 23 a of intake manifold 23. Above throttle plate 24d of the carburetor 24 there are included elements (not shown) for delivering liquid fuel in the form of a vapor or mist into the air stream moving downwardly through the body 24e of the carburetor. Even though the liquid fuel is aspirated or vaporized into the air stream in order to form a flow of a fuel-air mixture, portions of the fuel are not formed into vapor or mist in the air stream, but instead enter the air stream as droplets. Such droplets do not become part of the fuel-air mixture which is available for combustion within the engine. Accordingly the droplets reduce the efficiency of the engine in the terms of thermal efficiency or in the case of a vehicle, miles-per-gallon. The droplets by failing to be efficiently subjected to combustion within the engine, pass into the exhaust as unburned hydrocarbons. The failure of such droplets to be efficiently burned within the engine and their passing into the exhaust not only decreases the efficiency of the engine, but also increases the pollutants contained in the exhaust stream of the engine.

Investigations and experiments have shown that such fuel droplets tend to cling to the inner surface of the carburetor body 24e and then travel downwardly onto the inner surface of the inlet 23a of the intake manifold 23. Thereafter such droplets propagate along the inner wall 23c and ultimately pass into the combustion chamber of the engine.

As shown in FIGS. 2 and 6, droplets of fuel 25a in the fuel-air mixture moving through the carburetor 24 move adjacent to the inner surface of carburetor body 24e. There after the droplets impinge upon flange 21b of the outer body 21 and enter cavity 20a between the outer body 21 and inner body 22. Fuel droplets accumulate in cavity 20a and build up a level of liquid fuel in the cavity. The fuel-air mixture flowing adjacent flange 22d of the inner body and flange 21b of the outer body draw the liquid fuel from cavity 20a and disperse and vaporize the liquid fuel into the stream of fuel-air mixture 25 passing within the opening of the inner surface 22e of the inner body 22. The fuel-air mixture can remove liquid fuel from cavity 20a by physically forcing droplets of liquid fuel from the cavity into the fuel-air stream or can aspirate or, by a Venturi-effect, deliver the liquid fuel from the cavity 20a into the flow of the fuel-air mixture.

As a result of the trapping of liquid fuel droplets by the fuel-air mixing device 20 of the invention and by delivering trapped droplets as vapor or mist into the fuel-air mixture, device 20 prevents the passage of such fuel droplets into the intake manifold. The device 20 by subdividing or vaporizing the droplets into the fuel-air mixture, enables the fuel comprising the droplets to be efficiently burned within the engine along with the fuel-air mixture provided by carburetor or by a fuel injection device. Road testing of the device 20 shows the increased efficiency resulting from the device which enables the fuel droplets to be efficiently burned in the engine, thereby providing an increase in the miles-per-gallon of a motor vehicle. Furthermore, tests conducted on dynamometers or related test rigs, show a measurable and appreciable reduction of the pollutants of the exhaust of an engine such as reduced percentages of carbon monoxide and unburned hydrocarbons.

In FIGS. 9–14 there is shown another embodiment 30 of the fuel-air mixing device of the invention. Outer body 31 has a cylindrical wall 31a a mounting flange 31b, and a pair of surfaces 31c and 31d of increased diameter. Surface 31c and 31d enable the device 30 to be mounted with respect to an engine.

Figure 9:
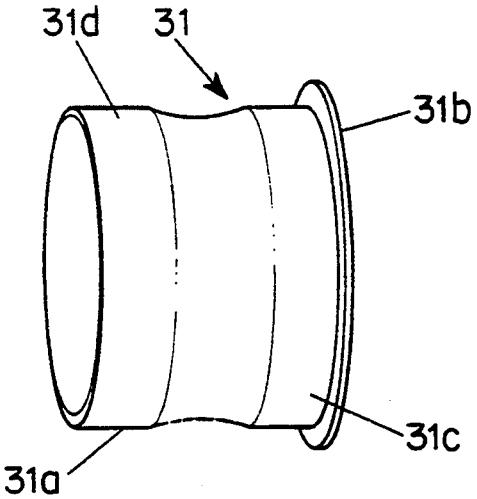
FIG. 9 is a perspective view of the outer body of another embodiment of the fuel-air mixing device of the invention.
Figure 10:
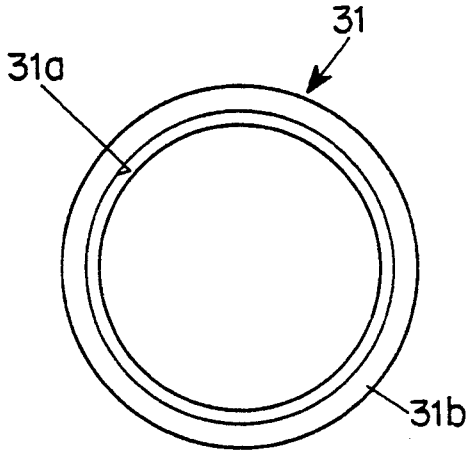
FIG. 10 is top plan view of the outer body of the fuel-air mixing device shown in FIG. 9.
Figure 11:
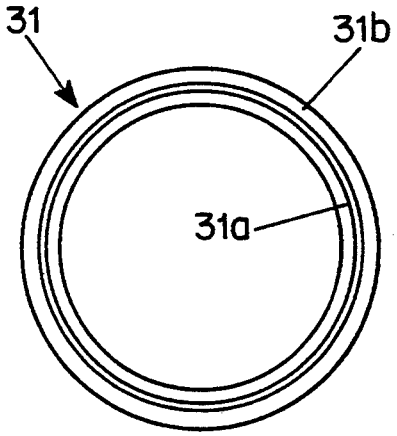
FIG. 11 is a bottom plan view of the outer body of the fuel-air mixing device shown in FIG. 9.
Figure 12:
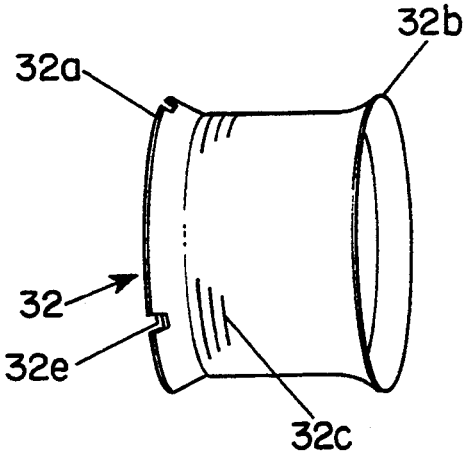
FIG. 12 is a perspective view of the inner body of the fuel-air mixing device which can be mounted in the outer body shown in FIGS. 10 and 11.
Figure 13:
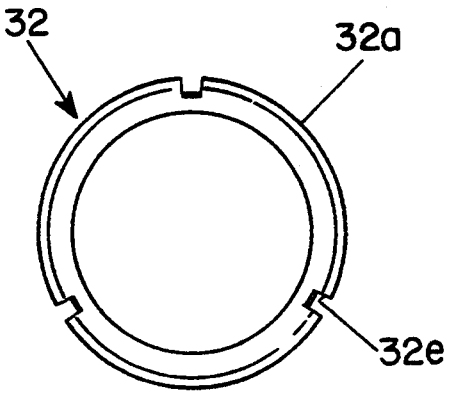
FIG. 13 is top plan view of the inner body of the fuel-air mixing device shown in FIG. 12.
Figure 14:
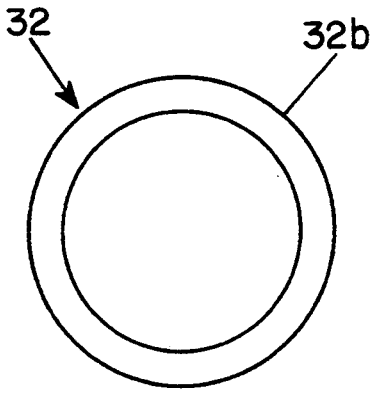
FIG. 14 is a bottom plan view of the inner body of the fuel-air mixing device shown in FIG. 13.

As shown in FIGS. 12–14 hollow inner body portion 32 is provided with a flange or flare 32a and a flange 32b. As shown in FIG. 9 flange 31b is at the entrance portion of device 30. Flange or flare 32a of inner body 32 is disposed adjacent to the interior surface of outer body 31, adjacent flange 31b. As shown in FIG. 13 inner body 32 can be provided with notches or indentations 32e spaced about the periphery of flange 32a. When inner body 32 is nested within outer body 31, the flanges are substantially coplanar and form an opening between the periphery of flange 32a and the interior surface of outer body 31a adjacent flange 31b thereof. The opening is in communication with a cavity formed between the interior surface of outer body 32 and the surface of inner body 32. Flange 32b of inner body 32 closes the opposite end portion of the cavity. Inner body 32 may have a plurality of openings and, as depicted in FIG. 12, these openings may be slots positioned dsymmetrically about the periphery of the inner body 32.

Device 30 can be disposed or mounted with respect to an engine as is shown in FIGS. 2 and 6 for fuel-air mixing device 20. Device 30 operates in trapping and thereafter releasing the fuel droplets as described above with respect to device 20.

Figure 8:
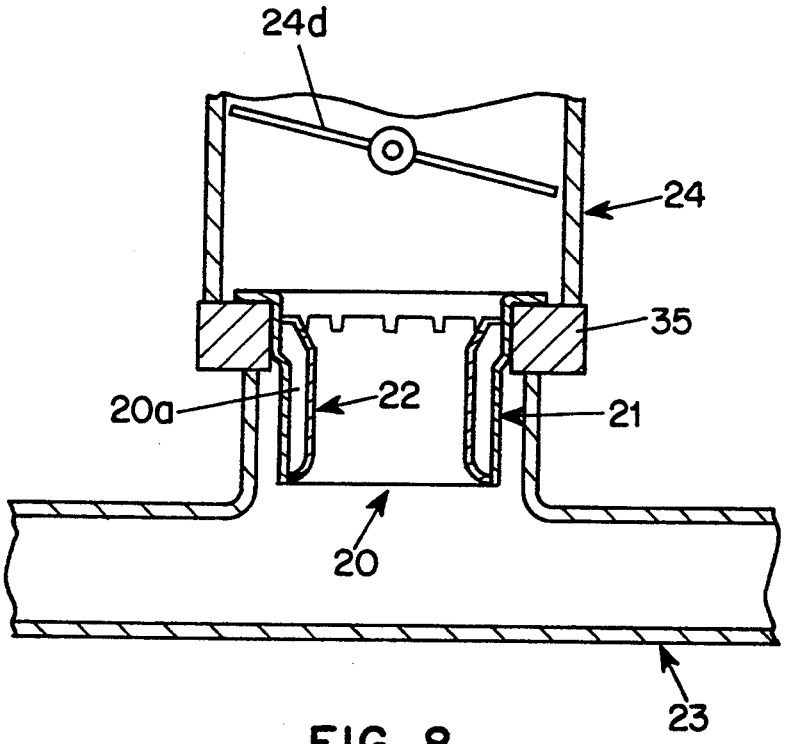
FIG. 8 is a fragmentary vertical section view of the fuel-air mixing device disposed in an adaptor which is mounted adjacent the inlet of an intake manifold.

As is shown in FIG. 8 an engine such as manifold 34 thereof can be provided with an adaptor 35 which is mounted on the manifold in order to facilitate the installation of the fuel-air mixing device 20 or 30 with respect to the engine. The adapter when installed on the engine enables fuel-air mixing device to be fitted and secured by the adaptor, regardless of the dimensions of the inlet of the manifold of the engine. Of course the carburetor 24 or a fuel-air injection device is mounted above the adaptor by conventional retaining elements such as bolts, clamps, or the like.

What is claimed is:

1. A fuel-air mixing device for receiving a flow of a fuel-air mixture and for delivering the flow of the fuel-air mixture to the inlet of an internal combustion engine, the fuel-air mixture containing droplets of unvaporized fuel, the device comprising:

a hollow outer elongated body portion having oppositely disposed open end portions; and a hollow inner elongated body portion having oppositely disposed additional open end portions, the inner body portion having a lateral cross-section enabling the inner body portion to be nested within the outer body portion with the exterior surface of the inner body portion forming a cavity with respect to the interior surface of the outer body portion, one end portion of the inner body portion being adapted to receive the fuel-air mixture containing droplets of unvaporized fuel, the other end portion of the inner body portion enabling the fuel-air mixture to be delivered to the inlet of the engine, the other end portion of the inner body portion extending to the outer body portion to close the portion of the cavity adjacent thereto, the portion of the cavity adjacent the one end portion of the inner body portion being open to receive droplets of unvaporized fuel into the cavity, the open portion of the cavity enabling droplets of unvaporized fuel to be accumulated in the cavity from the flow of fuel-air mixture and then to pass from the open portion of the cavity as vaporized fuel and into the fuel-air mixture passing through the inner body portion.

2. The fuel-air mixing device in accordance with claim 1 in which each of the outer body portion and the inner body portion are substantially cylindrical.

3. The fuel-air mixing device in accordance with claim 1 in which the end portion of the outer body portion disposed adjacent the open end portion of the inner body portion has an outwardly extending flange which can support the device adjacent the inlet of the engine.

4. The fuel-air mixing device in accordance with claim 3 in which the flange extends substantially at right angles to the length of the outer body portion.

5. The fuel-air mixing device in accordance with claim 3 in which the flange is an outwardly extending flare.

6. The fuel-air mixing device in accordance with claim 2 in which the outer body portion has an increased diameter adjacent the end portion thereof which is disposed adjacent the one end portion of the inner body portion, the increased diameter enabling the device to be mounted adjacent the inlet of the engine by engagement therewith.

7. The fuel-air mixing device in accordance with claim 2 in which the one end portion of the inner body portion extends adjacent the interior surface of the outer body portion.

8. The fuel-air mixing device in accordance with claim 7 in which the one end portion of the inner body portion is in the form of a flare.

9. The fuel-air mixing device in accordance with claim 8 in which the one end portion is serrated at a free edge of the flare.

10. The fuel-air mixing device in accordance with claim 2 in which the one end portion of the inner body portion extends outwardly adjacent the outer body portion with free edge of the one end portion being contiguous with an interior surface of the outer body portion and wherein the inner body portion and the outer body portion are substantially cylindrical.

11. The fuel-air mixing device in accordance with claim 1 in which a wall of one of the outer body portion and the inner body portion contains at least one opening extending into the cavity between the inner body portion and the outer body portion to enable a portion of the flow of the fuel-air mixture to pass through the opening and to cause the unvaporized fuel therein to pass from the open portion of the cavity as vaporized fuel and into the fuel-air mixture passing through the inner body portion.

12. The fuel-air mixing device in accordance with claim 11 in which the opening is disposed in the inner body portion.

13. The fuel-air mixing device in accordance with claim 11 in which the opening is disposed in the outer body portion.

14. The fuel-air mixing device in accordance with claim 1 further comprising an adaptor to be mounted adjacent the inlet of the internal combustion engine, the adaptor having an opening therein to be disposed in communication with the inlet, the opening in the adaptor corresponding to the hollow outer elongated body portion to enable the fuel-air mixing device to be supported by the adaptor with respect to the inlet of the engine.

15. A fuel-air mixing device for receiving a flow of a fuel-air mixture and for delivering the flow of the fuel-air mixture to an inlet of an internal combustion engine, the fuel-air mixture containing droplets of unvaporized fuel, the device comprising:

a hollow elongated cylindrical outer body with an inner diameter; and a hollow elongated cylindrical inner body with a first open end having a respective first edge, a second open end having a respective second edge, and a major axis along the elongated cylindrical shape of the elongated cylindrical inner body, an outer diameter of the inner body at an area adjacent the first open end and at an area adjacent the second open end being greater than an outer diameter of the inner body at an area surrounded by said areas adjacent the first and second open ends, said outer diameter of the inner body at the areas adjacent the first and second open ends being substantially equal to the inner diameter of the outer body, the inner body being nested within the outer body to form a cavity between the outer body and the inner body, wherein the first edge has a plurality of circumferentially spaced indentations, and wherein the inner body has a plurality of openings circumferentially disposed about the circumference of the inner body.

16. The fuel-air mixing device of claim 15, wherein said plurality of openings are slots which are perpendicular to the major axis of the elongated cylindrical inner body.

* * * * *